US006126479A

United States Patent [19]

Lee

[11] Patent Number: 6,126,479

[45] Date of Patent: Oct. 3, 2000

[54] ATA CONNECTOR HAVING A PULL HANDLE

[75] Inventor: George Lee, Taipei, Taiwan

[73] Assignee: Hon Hai Precision Ind. Co,, Ltd., Taipei Hsien, Taiwan

[21] Appl. No.: 09/203,038

[22] Filed: Nov. 30, 1998

[51] Int. Cl.[7] ..... H01R 13/00

[52] U.S. Cl. ..... 439/484

[58] Field of Search ..... 439/484, 483, 439/476.1, 152.9, 160

[56] References Cited

U.S. PATENT DOCUMENTS 4,586,768 5/1986 Eck ..... 439/484

4,881,911 11/1989 Haddock et al. ..... 439/484

4,973,255 11/1990 Rudoy ..... 439/157

*Primary Examiner*—Neil Abrams

*Assistant Examiner*—Eugene G. Byrd

*Attorney, Agent, or Firm*—Wei Te Chung

[57] ABSTRACT

An ATA connector comprises a dielectric housing having a termination face and a mating face. A plurality of passageways is defined between the termination face and the mating face. A pair of retaining wedges is integrally formed on opposite ends of the housing. A plurality of terminals is assembled to the corresponding passageways. A cover is assembled to the termination face of the housing. A pair of retaining latches is integrally formed on opposite ends of the cover for engaging with the retaining wedges. A slot is defined between transverse sides of the cover.

5 Claims, 5 Drawing Sheets

ATA CONNECTOR HAVING A PULL HANDLE

BACKGROUND OF THE INVENTION

The present invention relates to an AT attachment (ATA) connector, and more particularly to an ATA connector having a flexible pull tab.

DESCRIPTION OF PRIOR ART

An ATA connector comprises a dielectric housing having a mating face and a connecting face. A plurality of passageways are defined between the mating face and the connecting face. The housing includes a pair of retaining lugs on distant ends thereof. A plurality of terminals are assembled in the corresponding passageways. Each terminal has a body portion extending between an insulation displacement section and a connecting portion. The insulation displacement sections extend beyond the mating face for termination with a ribbon cable assembled thereto. In general, the insulation displacement sections are arranged in rows. A cover having top and bottom faces is assembled to the mating face of the housing for terminating conductive wires of the ribbon cable to the insulation displacement sections.

When a user wants to remove an ATA connector from a header connector assembled on a printed circuit board, it is difficult to grip the ATA connector. The user generally pulls the ribbon cable assembled thereto to remove the ATA connector therefrom. As a result, connections between the insulation displacement sections and conductors of the ribbon cable will be adversely affected. In order to solve this problem, several approaches have been introduced.

FIG. 1A discloses a typical approach. The ATA connector 1*a* includes a second cover or a strain relief cover 1*c* which is stacked on a first cover or an IDC cover 1*b* which terminates the ribbon cable 1*d* to the insulation displacement sections. A tail portion 1*e* of the ribbon cable 1*d* extends between the first and second covers 1*b,* 1*c* for strain relief. During assembly, a pull tab 1*f* is assembled between the first and second covers. This provides a basis for removal of the ATA connector 1*a* from the header connector without hindering the connections between the insulation displacement sections and the ribbon cable. However, the second cover inevitably increases costs.

FIG. 1B discloses another approach which utilizes a U-shaped lift bar 2*a* to replace the second cover 1*c* and the pull tab 1*f* of FIG. 1A. The lift bar 2*a* includes a pair of legs 2*b* each having a hook 2*c* engaged with the first cover 2*d*. This increases the height of the ATA connector 2 which is not acceptable for compact design. In addition, the increased height may hinder other components.

FIGS. 2A, 2B, 2C and 3A, 3B, 3C disclose an improvement wherein the lift bars 3*a*, 3*b* can be bent horizontally to reduce the overall height. However, openings 3*c*, 3*d* defined between the lift bars 3*a*, 3*b* and the housing may trap other components therein.

SUMMARY OF THE INVENTION

An objective of this invention is to provide an ATA connector having a pull handle without increasing the height of the connector or requiring additional components.

In order to achieve the objective set forth, an ATA connector comprises a dielectric housing having a termination face and a mating face. A plurality of passageways are defined between the termination face and the mating face. A pair of retaining wedges is integrally formed on opposite ends of the housing. A plurality of terminals is assembled in the corresponding passageways. A cover is assembled to the termination face of the housing. A pair of retaining latches is integrally formed on opposite ends of the cover for engagement with the retaining wedges. A slot is defined between transverse sides of the cover.

According to one aspect of the invention, a pull tab extends through the slot of the cover for disengaging the ATA connector from a header connector without jeopardizing connections between the insulation displacement sections and conductors of the ribbon cable.

These and additional objectives, features, and advantages of the present invention will become apparent after reading the following detailed description of the preferred embodiment of the invention taken in conjunction with the appended drawings.

DETAILED DESCRIPTION OF PREFERRED EMBODIMENT

Figure 4A:
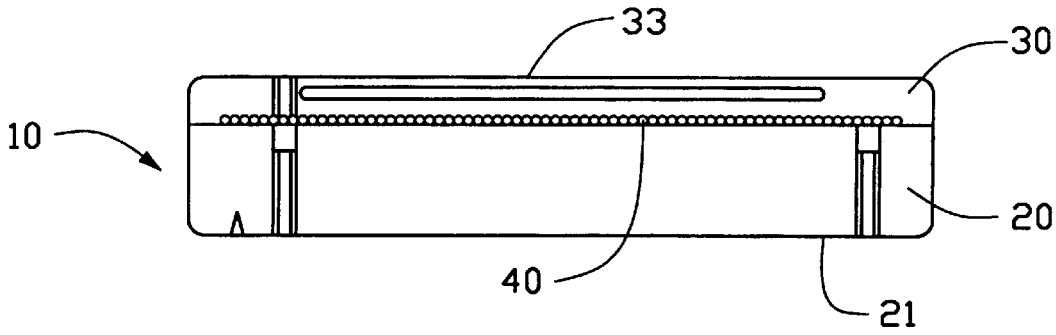
FIG. 4A is a front view of an ATA connector in accordance with the present invention.
Figure 4B:
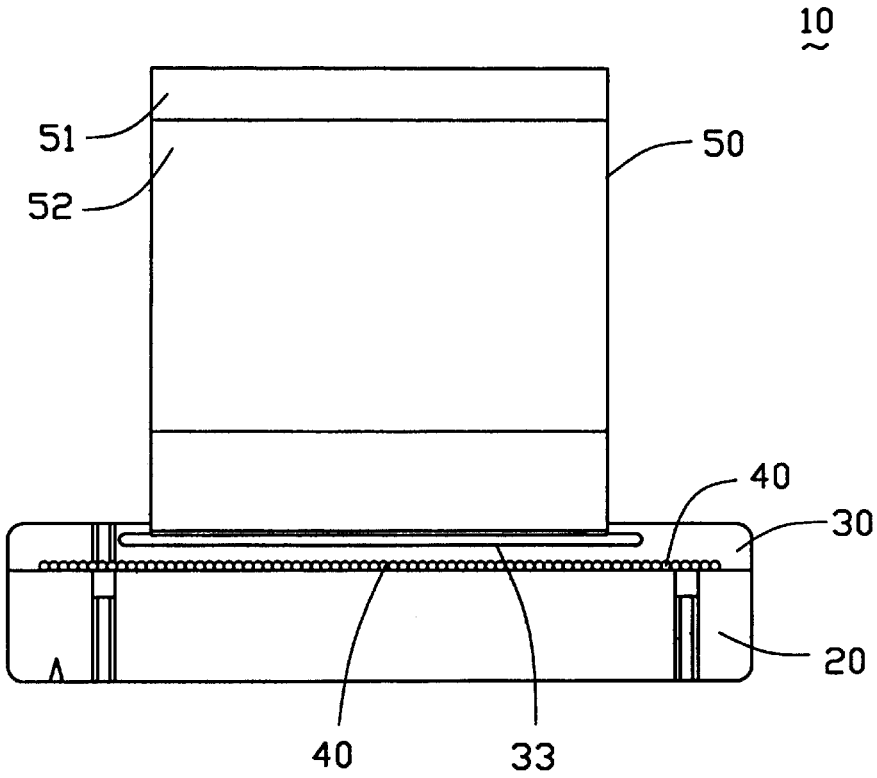
FIG. 4B is similar to FIG. 4A with a pull tab assembled thereto.
Figure 4C:
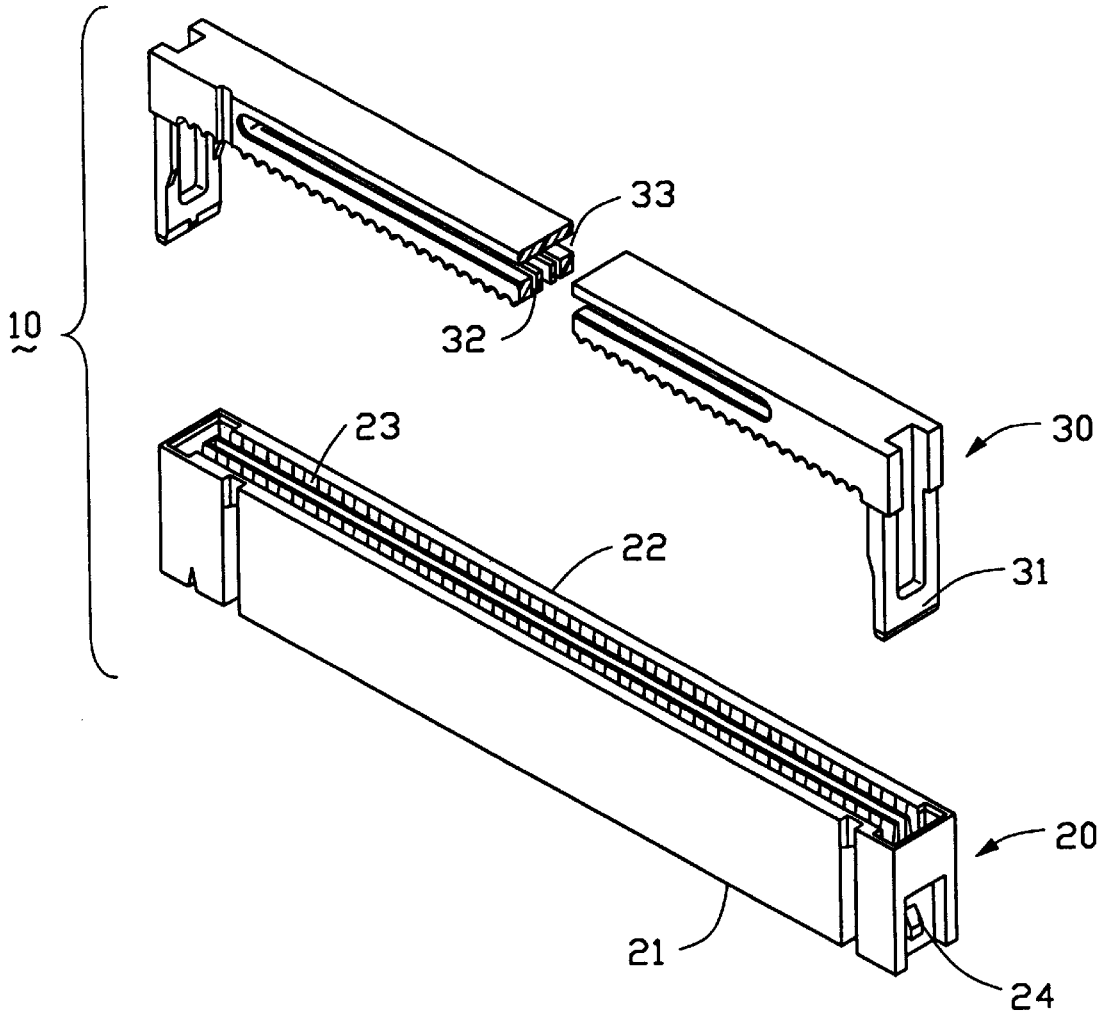
FIG. 4C is an exploded view of the ATA connector of FIG. 4A with a portion of a housing cut away.

Referring to FIGS. 4A, 4B and 4C, "At" is an abbreviation of "Advanced Technology" which is sued to describe the level of personal computer, while the last "A"is an abbreviation of Attachment.

An ATA connector 10 in accordance with the present invention generally comprises a housing 20 and a cover 30 securely attached thereto. The housing 20 has a mating face 21 for coupling with a header connector (not shown) and a termination face 22 opposite the mating face 21. A plurality of passageways 23 is defined between the mating face 21 and the termination face 22. Each passageway 23 receives a terminal (not shown) having a body portion extending between an insulation displacement section and a contact portion. The insulation displacement section extends beyond the termination face 22 for termination with a ribbon cable 40 assembled thereto. Since this is known to those skilled in the art a detailed description thereof is omitted herein.

Figure 1A:
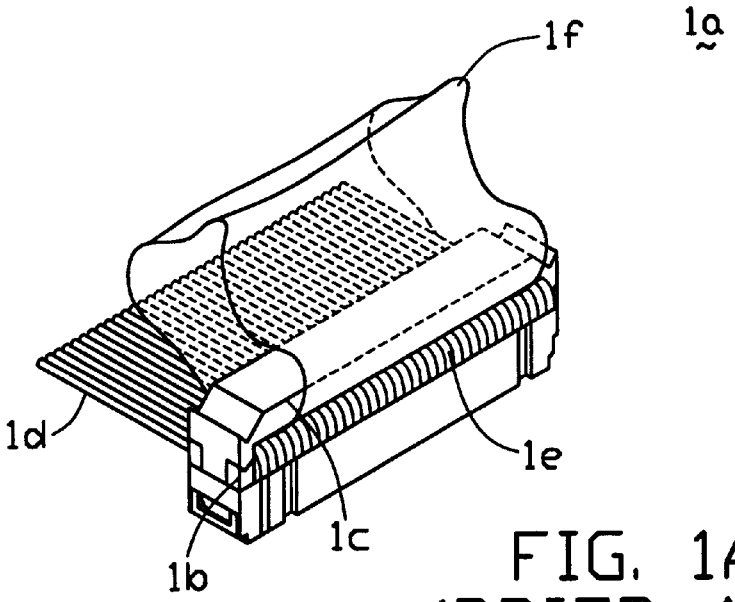
FIG. 1A (PRIOR ART)
FIG. 1A is a perspective view of a conventional ATA connector having a pull tab assembled thereto.
Figure 1B:
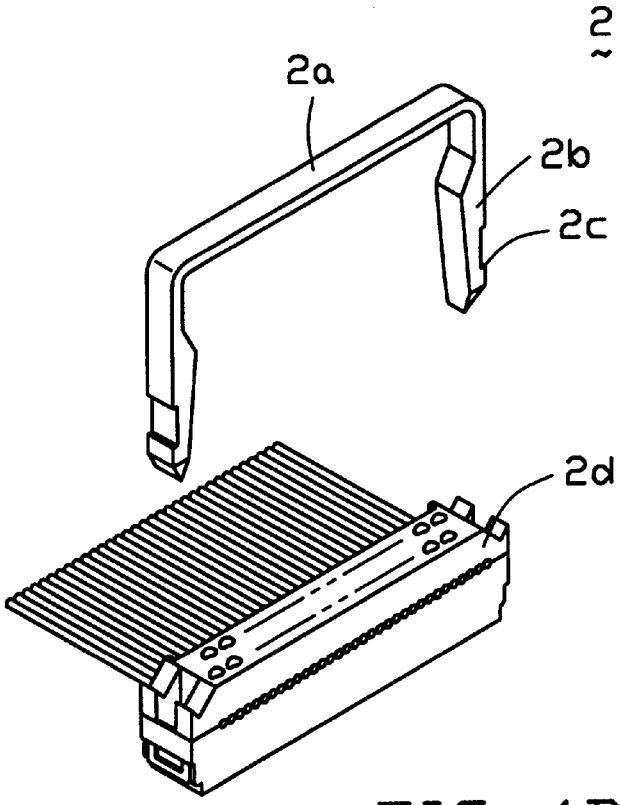
FIG. 1B (PRIOR ART)
FIG. 1B is a perspective view of another conventional ATA connector having a lift bar.
Figure 2A:
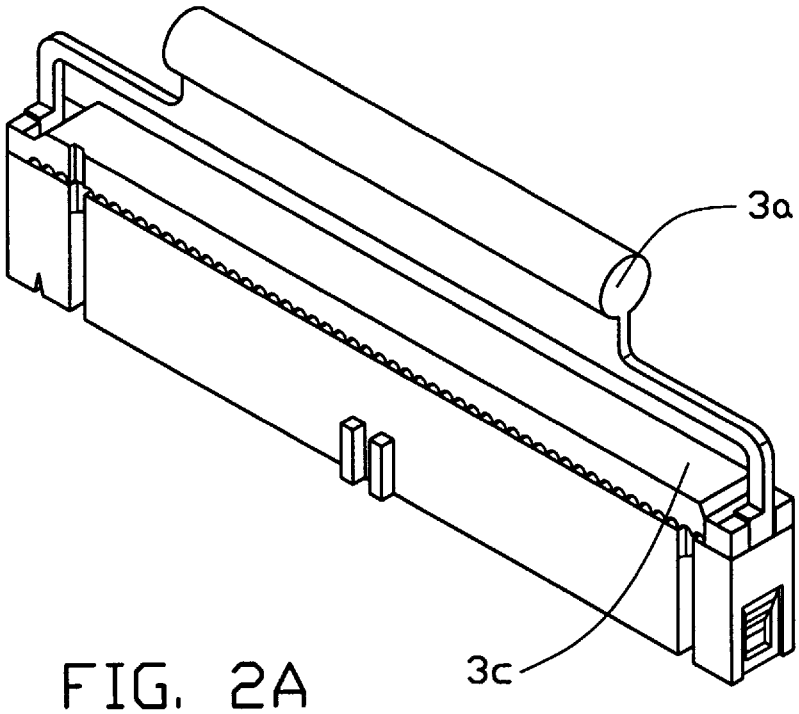
FIG. 2A (PRIOR ART)
FIG. 2A is a perspective view of another conventional ATA connector similar to FIG. 1B.
Figure 2B:
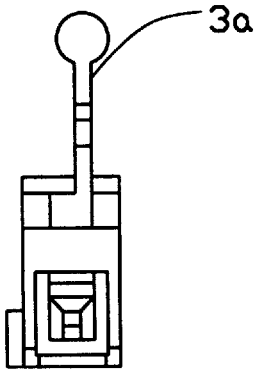
FIG. 2B (PRIOR ART)
FIG. 2B is an end view of FIG. 2A with a lift bar extending vertically.
Figure 2C:
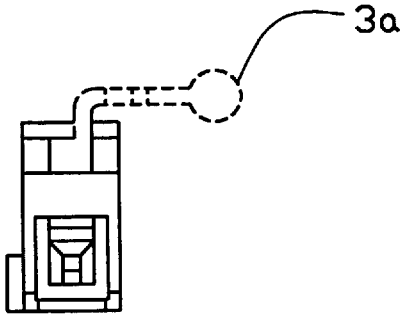
FIG. 2C (PRIOR ART)
FIG. 2C is an end view of FIG. 2A with the lift bar extending horizontally.
Figure 3A:
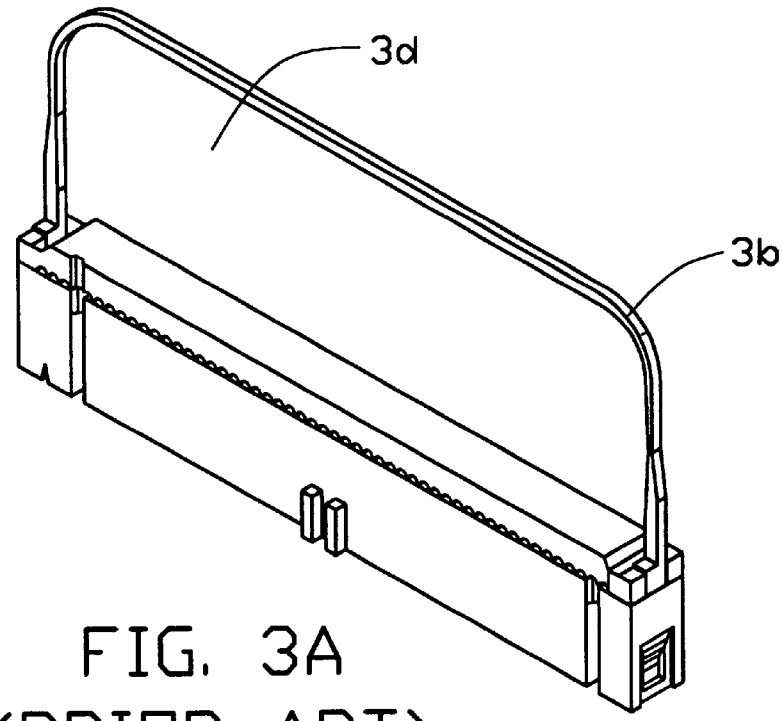
FIG. 3A (PRIOR ART)
FIG. 3A is a perspective view of another conventional ATA connector similar to FIG. 1B.
Figure 3B:
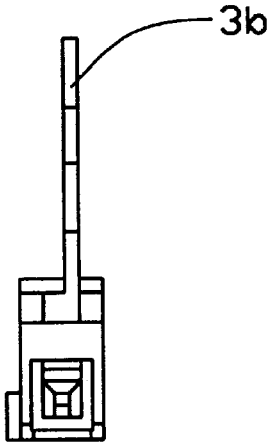
FIG. 3B (PRIOR ART)
FIG. 3B is an end view of FIG. 3A with a lift bar extending vertically.
Figure 3C:
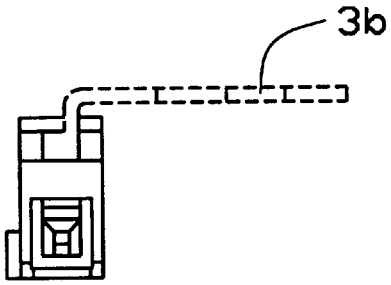
FIG. 3C (PRIOR ART)
FIG. 3C is an end view of FIG. 3A with the lift bar extending horizontally.

The cover 30 includes a pair of latches 31 for engaging with retaining wedges 24 of the housing 20. The cover 30 also defines a pair of grooves 32 for receiving the insulation displacement sections. The cover 30 further includes a slot 33 defined between longitudinal sides thereof. A pull tab 50 extends through the slot 33. The pull tab 50 includes ends 51 and 52 which are sealed together to define a loop for receiving fingers therein. A user can lift the pull tab 50 to remove the ATA connector 10 from the header. By this arrangement, no excessive force will be applied to connections between the insulation displacement sections and the ribbon cable. Furthermore, additional elements, such as a strain relief cover 1*c,* are not required. In comparison with the prior art shown in FIG. 1A, the invention requires no strain relief cover to cooperate with the pull tab, thus saving cost. In comparison with the prior art shown in FIGS. 1B, 2A–2C and 3A–3C, the invention maintains a smaller dimension. In brief, the invention keeps the advantages and prevents the disadvantages with regard to the foregoing several prior arts.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An ATA connector, comprising:

a dielectric housing having a termination face and a mating face, a pair of retaining wedges integrally formed on oppsite ends of said housing;

a cover assembled to said termination face of said housing, a pair of retaining latches integrally formed on opposite ends of said cover for engaging with said retaining wedges; and a slot defined between said transverse sides of said cover and communicating with an exterior only in a lateral direction, and not directly substantially communicating with or exposed to the housing thereunder; wherein a pull tab extends through said slot of said cover for disengaging said ATA connector from a header connector without jeopardizing connections between the ATA connector and conductors of said ribbon cable terminated to said ATA connector.

2. The ATA connector as recited in claim 1, wherein a bottom face of said cover defines at least a groove.

3. The ATA connector as recited in claim 1, wherein a bottom face of said cover defines a plurality of shallow channels each receiving a corresponding wire of said ribbon cable therein.

4. A connector, comprising:

a dielectric housing defining a termination face and a mating face with a plurality of passageway therebetween;

a cover attached to the housing, said cover forming a slot therein; and a pull tab extending through said slot wherein a user can pull up the connector from a mating header connector by means of said pull tab; and wherein said slot communicates with an exterior only along a lateral direction while is spatially segregated from the housing thereunder by a bottom portion of the cover.

5. The connector as recited in claim 4, wherein the pull tab includes two opposite ends being sealed together to define a loop for receiving a finger therein.

* * * * *